US009885140B2

(12) United States Patent
Tietz et al.

(10) Patent No.: US 9,885,140 B2
(45) Date of Patent: Feb. 6, 2018

(54) FOREIGN OBJECT TRAP FOR A LAUNDRY TREATING APPLIANCE

(71) Applicant: WHIRLPOOL CORPORATION, Benton Harbor, MI (US)

(72) Inventors: Dean L. Tietz, Saint Joseph, MI (US); George L. Turner, Stevensville, MI (US)

(73) Assignee: Whirlpool Coporation, Benton Harbor, MI (US)

( * ) Notice: Subject to any disclaimer, the term of this patent is extended or adjusted under 35 U.S.C. 154(b) by 102 days.

(21) Appl. No.: 14/824,741

(22) Filed: Aug. 12, 2015

(65) Prior Publication Data

US 2015/0345060 A1 Dec. 3, 2015

Related U.S. Application Data

(62) Division of application No. 13/334,295, filed on Dec. 22, 2011, now Pat. No. 9,127,394.

(51) Int. Cl.

| | |
|---|---|
| ***D06F 35/00*** | (2006.01) |
| ***D06F 39/10*** | (2006.01) |
| ***D06F 37/12*** | (2006.01) |
| ***D06F 37/26*** | (2006.01) |
| ***D06F 23/04*** | (2006.01) |
| ***D06F 39/08*** | (2006.01) |

(52) U.S. Cl.

CPC ..... *D06F 39/10* (2013.01); *D06F 23/04* (2013.01); *D06F 35/005* (2013.01); *D06F 37/12* (2013.01); *D06F 37/263* (2013.01); *D06F 39/083* (2013.01)

(58) Field of Classification Search

CPC ..... D06F 39/10; D06F 39/083; D06F 37/12; D06F 23/04; D06F 35/005

USPC ..... 68/18 F, 23.3, 53, 208; 210/167.01, 210/167.31, 408, 409, 411

See application file for complete search history.

(56) References Cited

U.S. PATENT DOCUMENTS

| | | | | |
|---|---|---|---|---|
| 2,414,645 | A | 1/1947 | Hays, Jr. | |
| 2,470,140 | A | 5/1949 | Castner | |
| 2,645,109 | A | 7/1953 | Smith | |
| 2,720,771 | A | 10/1955 | Lewis | |
| 2,900,812 | A | 8/1959 | Smith | |
| 3,216,224 | A | 11/1965 | Poole | |
| 3,246,837 | A | 4/1966 | Douglas | |
| 3,310,063 | A * | 3/1967 | Edwards | D06F 39/083 137/216 |
| 3,352,130 | A | 11/1967 | Landwier | |
| 3,626,728 | A | 12/1971 | Traube et al. | |
| 4,075,876 | A | 2/1978 | Platt | |
| 4,357,812 | A | 11/1982 | Braga et al. | |
| 4,357,813 | A | 11/1982 | Sherer et al. | |

(Continued)

FOREIGN PATENT DOCUMENTS

| | | |
|---|---|---|
| CN | 2433281 Y | 6/2001 |
| CN | 2446142 Y | 9/2001 |

(Continued)

*Primary Examiner* — Joseph L Perrin

(57) ABSTRACT

A method of operating a laundry treating appliance having a foreign object trap located in a bottom of a wash basket underlying a clothes mover, the bottom of the wash basket having an upwardly extending wall, with at least the wash basket rotatable about an axis of rotation, the method including radially expelling liquid through an outlet opening of the foreign object trap.

19 Claims, 10 Drawing Sheets

(56) References Cited

U.S. PATENT DOCUMENTS

| | | | | |
|---|---|---|---|---|
| 4,455,844 | A | 6/1984 | McMillan et al. | |
| 4,485,645 | A | 12/1984 | Mulder et al. | |
| 4,848,105 | A | 7/1989 | O'Connell et al. | |
| 4,949,557 | A | 8/1990 | Price | |
| 5,018,372 | A | 5/1991 | Altnau, Sr. | |
| 5,989,418 | A | 11/1999 | Shin | |
| 6,076,378 | A | 6/2000 | Shin | |
| 6,584,812 | B1 * | 7/2003 | Killane | D06F 39/085 68/18 F |
| 6,820,447 | B2 | 11/2004 | Thies et al. | |
| 2008/0196452 | A1 | 8/2008 | Bae et al. | |
| 2008/0216518 | A1 | 9/2008 | Yoo et al. | |
| 2008/0216522 | A1 | 9/2008 | Yoo et al. | |
| 2011/0146354 | A1 | 6/2011 | Lalonde et al. | |

FOREIGN PATENT DOCUMENTS

| | | | |
|---|---|---|---|
| GB | 795853 | | 5/1958 |
| GB | 843788 | | 8/1960 |
| JP | 9266998 | A | 10/1997 |
| JP | 10263288 | A | 10/1998 |
| KR | 20070090402 | A | 9/2007 |

* cited by examiner

FOREIGN OBJECT TRAP FOR A LAUNDRY TREATING APPLIANCE

CROSS REFERENCE TO RELATED APPLICATIONS

The present application is a divisional of U.S. patent application Ser. No. 13/334,295, filed Dec. 22, 2011, now U.S. Pat. No. 9,127,394, issued Sep. 8, 2015, which is incorporated herein by reference in its entirety.

BACKGROUND OF THE INVENTION

In a laundry treating appliance, such as an automatic clothes washer, the system is designed to process only fabric materials; however, other foreign objects make their way into the wash chamber including buttons, coins, keys, stones, and other small objects. These foreign objects may interfere with the proper operation of the appliance, such as interfering with proper liquid flow through a pump or pumps used for recirculation and draining, and may also damage the recirculation and/or draining pumps.

Prior clothes washers have addressed the problem by collecting and holding foreign objects, which may cause a number of problems. Collective materials may eventually reduce flow rates by obstructing water flow paths. Some collected materials deteriorate with time and may be redistributed on clothing or cause odor. Other types of materials may add to the accumulation process by causing materials to accumulate that might otherwise be pumped down the drain.

BRIEF DESCRIPTION

According to an embodiment of the invention, a method of operating a laundry treating appliance having a foreign object trap located in a bottom of a wash basket underlying a clothes mover, the bottom of the wash basket having an upwardly extending wall, with at least the wash basket rotatable about an axis of rotation comprises radially expelling liquid through a first portion of an outlet opening of the foreign object trap located in the upwardly extending wall and which is not at a right angle to the axis of rotation as the wash basket is rotated about the axis of rotation.

DESCRIPTION

Figure 1:
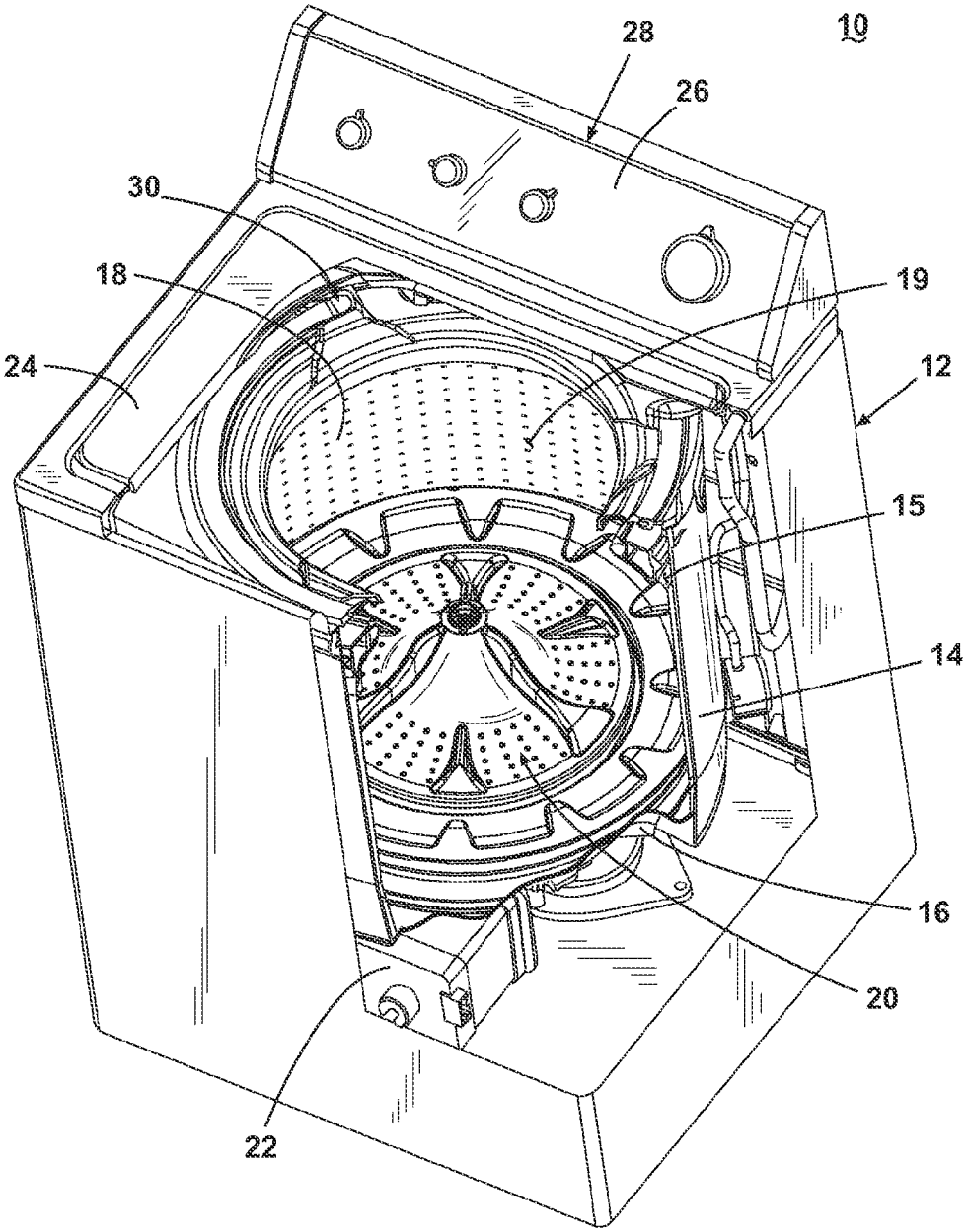
FIG. 1 is a perspective view of a laundry treating appliance according to one embodiment of the invention with a portion cut-away to show interior components of the laundry treating appliance.

Referring now to the figures, FIG. 1 is a schematic view of an exemplary laundry treating appliance 10 according to one embodiment of the invention. While the laundry treating appliance 10 is illustrated as a top-fill washing machine, the invention may have applicability in other laundry treating appliances, such as a combination laundry treating appliance and dryer, an extractor, a non-aqueous laundry treating appliance, and a tumbling or stationary refreshing/revitalizing machine, for example.

The laundry treating appliance 10 may include a cabinet or housing 12 and an imperforate tub 14 that defines an interior 15 of the laundry treating appliance 10. A sump 16 may be in fluid communication with the interior 15 of the tub 14. A drum or perforated wash basket 18 may be located within and rotatable relative to the interior 15 of the tub 14 and may define a laundry treating chamber 19 for receiving a laundry load. An agitator or clothes mover 20 may be located within the laundry treating chamber 19 and rotatable relative to and/or with the wash basket 18.

The wash basket 18 and/or the clothes mover 20 may be driven by an electrical motor 22, which may or may not include a gear case, operably connected to the wash basket 18 and/or the clothes mover 20. The clothes mover 20 may be commonly oscillated or rotated about its axis of rotation during a cycle of operation in order to produce high water turbulence effective to treat the fabric load contained within the laundry treating chamber 19. The wash basket 18 may be rotated at high speed to centrifugally extract liquid from the fabric load and to discharge it from the wash basket 18.

The top of the housing 12 may include a selectively openable lid 24 to provide access into the laundry treating chamber 19 through the open top of the wash basket 18. A user interface 26, which may be located on a console 28, may include one or more knobs, switches, displays, and the like for communicating with a user, such as to receive input and provide output.

Figure 2:
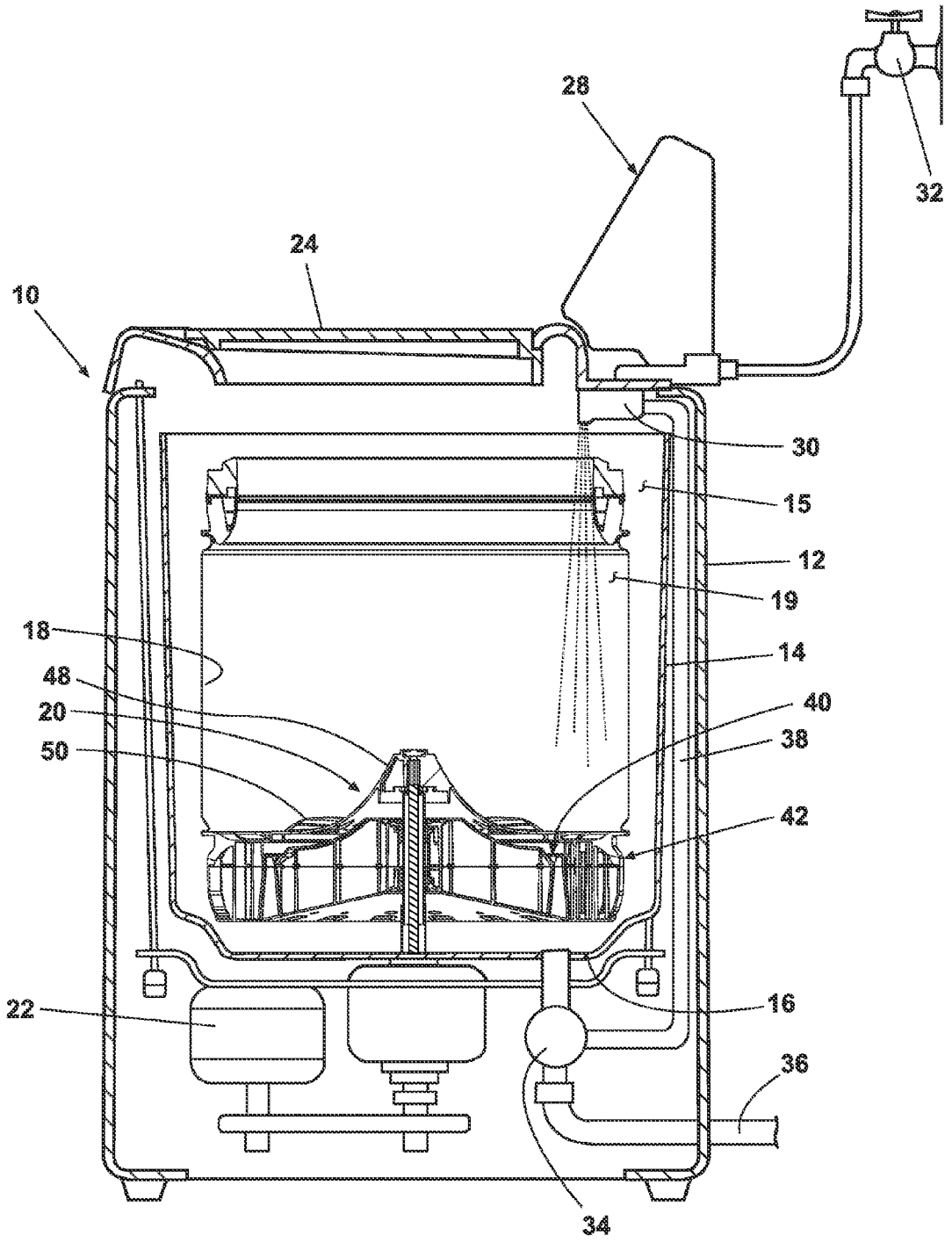
FIG. 2 is a schematic cross-sectional view of the interior components of the laundry treating appliance of FIG. 1.

Referring to FIG. 2, a spraying system 30 may be provided to spray liquid, such as water or a combination of water and one or more treating agents, such as detergent, into the open top of the wash basket 18 and onto laundry placed within the laundry treating chamber 19. The spraying system 30 may be configured to supply water directly from a household water supply 32 and/or from the tub 14 and spray it onto the laundry. The spraying system 30 may also be configured to recirculate wash water from the tub 14, including the sump 16, and spray it onto the laundry. The nature of the spraying system is not germane to the invention, and thus any suitable spraying system may be used with the laundry treating appliance 10.

As used herein, the terms liquid, water, and wash water are interchangeable and may refer to water or a combination of water and one or more treating agents, including detergents, bleaches, fabric softeners, fragrances, odor removers and stain treatments, for example. The liquid may also include entrained particulate matter, such as fine particulates, and other foreign objects of various sizes that were carried by the laundry placed within the laundry treating chamber 19.

A pump 34 may be housed below the tub 14. The pump 34 may have an inlet fluidly coupled to the sump 16 and an outlet configured to fluidly couple to either or both a household drain 36 or a recirculation conduit 38. In this configuration, the pump 34 may be used to drain or recirculate liquid in the sump 16, which is initially sprayed into the wash basket 18, flows through the wash basket 18, and then into the sump 16. Alternatively, two separate pumps may be used instead of the single pump as previously described.

A foreign object trap 40 may be provided to stop some foreign objects, such as coins and buttons, for example from reaching the pump 34, as such items may cause issues in the operation of the pump 34. The foreign object trap 40 may also be designed to allow some foreign objects, which will not interfere with the operation of the pump, such as toothpicks, lint, and sand, to pass through to the pump 34 where they may be directed to the drain 36. The pump 34 may be capable of handling normal quantities of these materials without a problem due to the amount of motor torque typically used in pumps for laundry treating appliances and clearances within the pump 34.

Figure 3:
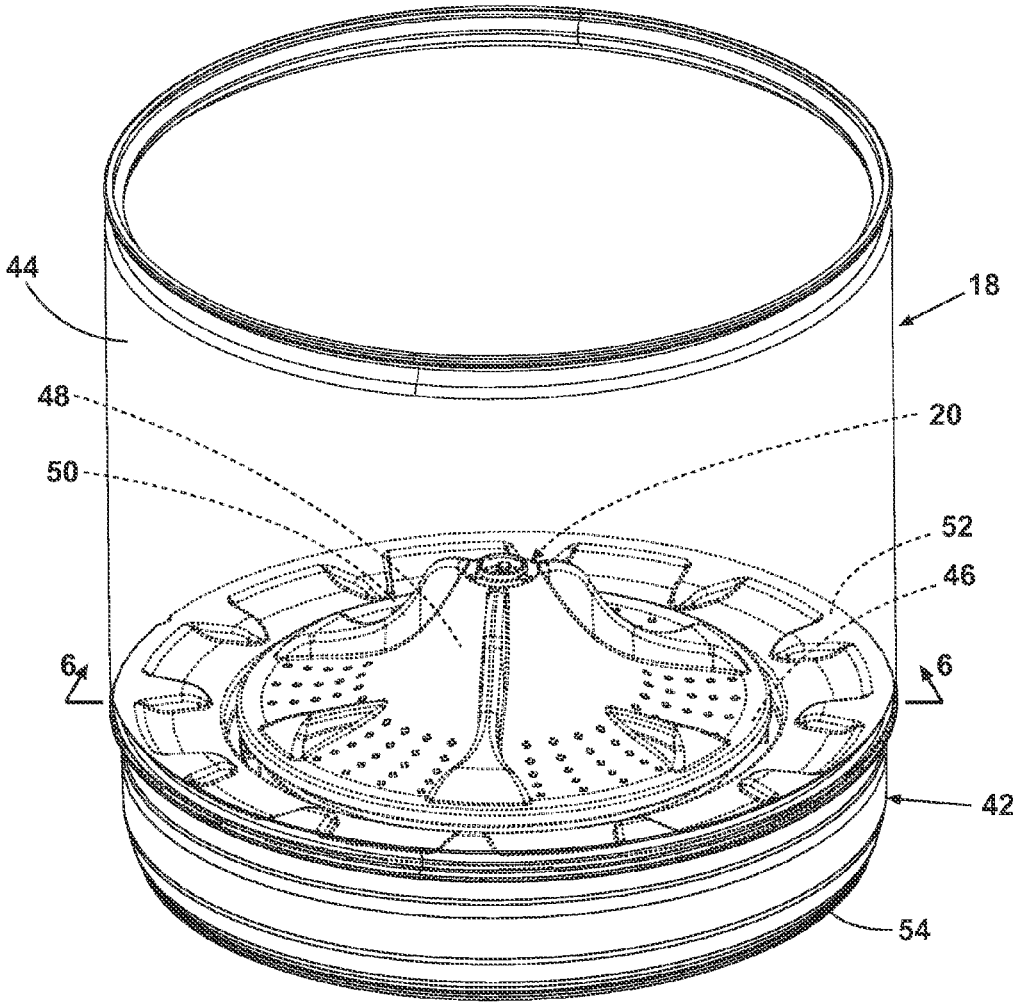
FIG. 3 is a perspective view of a wash basket, impeller, and base of the laundry treating appliance of FIG. 1.
Figure 4:
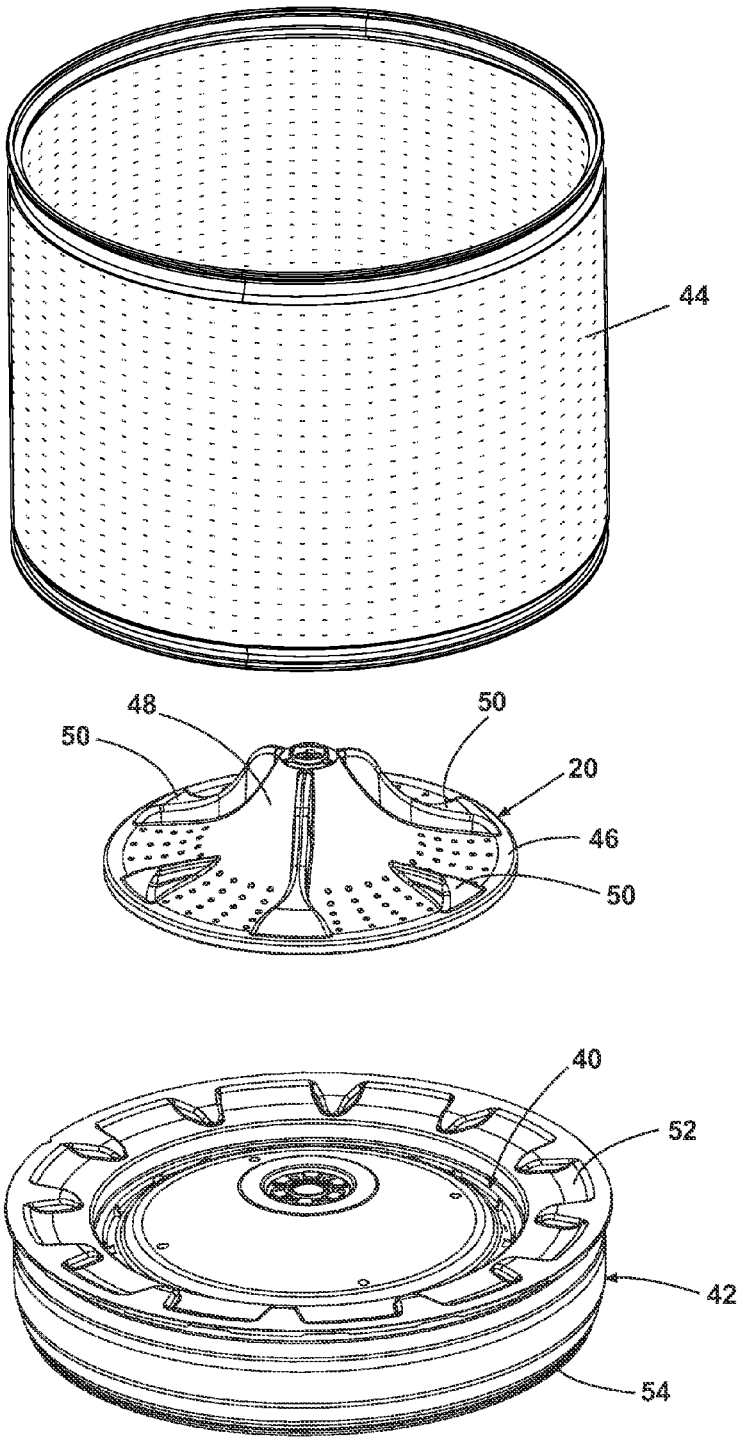
FIG. 4 is an exploded view of the wash basket, impeller, and base shown in FIG. 3.

FIG. 3 illustrates the wash basket 18 and clothes mover 20 in more detail. The wash basket 18 may include a bottom or base 42 and a perforated cylindrical portion 44. The perforations or holes in the basket 18 are not illustrated in FIG. 3 for the purposes of clarity. The perforated cylindrical portion 44 extends up from the base 42 to define an open-ended drum. The clothes mover 20 may be more easily seen in FIG. 4. The exemplary clothes mover 20 may have a lower circular base or peripheral skirt portion 46, a central shaft 48 extending upwardly from the skirt 46, and a plurality of vanes or blades 50 spaced around and extending radially from the central shaft 48. The clothes mover 20 overlies at least a portion of the base 42 of the wash basket 18 and, as illustrated in FIG. 3, the clothes mover 20 may extend over a substantial portion thereof. The lower end of the skirt 46 stops just short of the base 42. This allows liquid to flow under the clothes mover 20 and into the base 42 of the wash basket 18. The design of the clothes mover 20 is not germane to the invention and it will be understood that a variety of other designs for the clothes mover 20 may also be used without affecting the scope of the invention.

Figure 5:
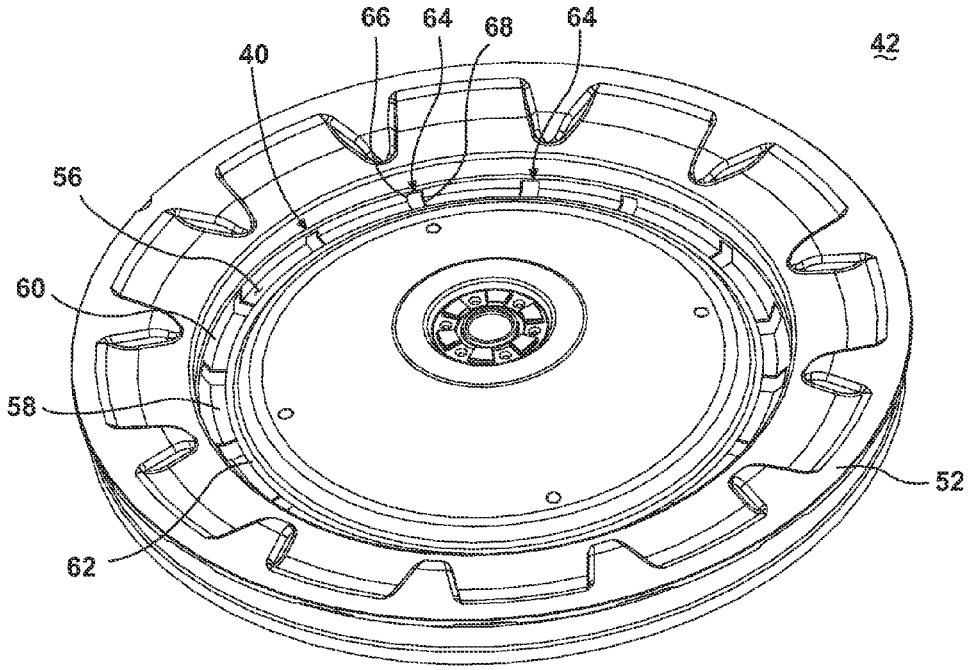
FIG. 5 is an exploded view of the base shown in FIG. 4.
Figure 5:
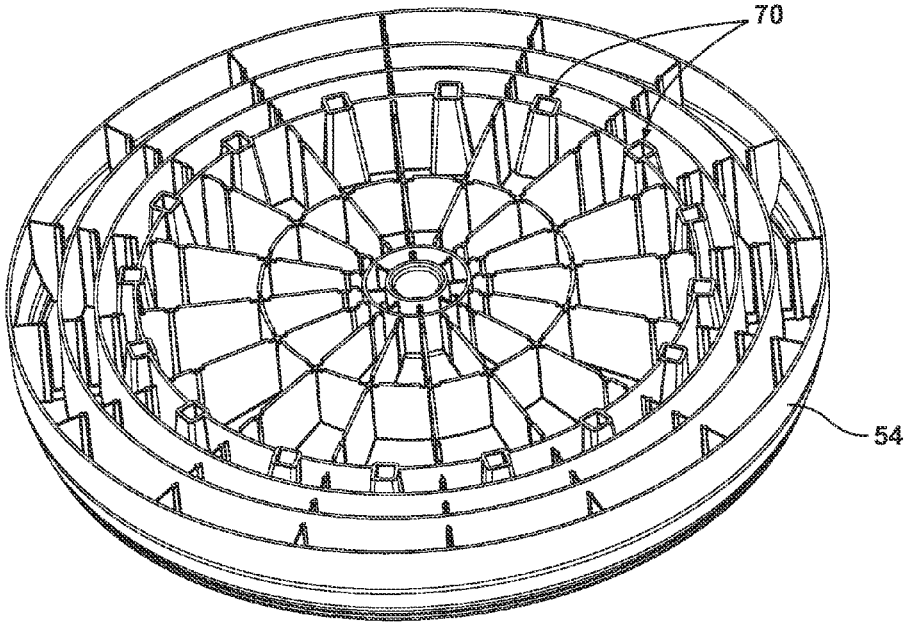

Referring now to FIG. 5, the base 42 includes an upper part 52 and a lower part 54. The foreign object trap 40 may be located within a channel 56 formed in the upper part 52 of the base 42. The channel 56 may be defined by a channel bottom wall 58, a radially outwardly located (with respect to the axis of rotation), upwardly extending outer sidewall 60, and a radially inwardly located, upwardly extending inner sidewall 62. Alternatively, the foreign object trap 40 may located within a step in the upper part 52 of the base 42. A plurality of outlet openings 64 may be provided within the channel 56, each outlet opening 64 having a first portion 66 formed in the outer sidewall 60 and a second portion 68 formed in the channel bottom wall 58. The first portion 66 forms a portion of the outlet opening 64 that is not at a right angle with respect to the axis of rotation of the wash basket 18, and the second portion 68 forms a portion of the outlet opening 64 that is generally perpendicular to the axis of rotation. As used herein, the first portion 66 is considered to not be at a right angle with the axis of rotation based on the formation of the first portion 66 in a surface that is generally not perpendicular to the axis of rotation of the wash basket 18 and may even be generally parallel with the axis of rotation, as illustrated. The second portion 68 of the outlet opening 64 is considered to be at a right angle or perpendicular to the axis of rotation based on the formation of the second portion 68 in a surface that is generally perpendicular with the axis of rotation of the wash basket 18.

The first and second portions 66 and 68 of the outlet opening 64 may have a generally rectangular shape, as illustrated, or any other geometric shape, such as circular or semi-circular, for example. The number of outlet openings 64, the spacing of the outlet openings 64 and the shape and size of the first and second portions 66 and 68 may be configured to provide a collective volumetric flow rate greater than a predetermined volumetric flow rate of the pump 34. The foreign object trap 40 may be designed such that even if one or more than one of the outlet openings 64 is blocked, the volumetric flow rate of the remaining outlet openings 64 is greater than the volumetric flow rate of the pump 34. This ensures that the flow rate to the pump 34 is sufficient for proper operation of the pump 34. In addition to flowing through the outlet openings 64, liquid also flows out of the treating chamber 19 through the perforations in the washing basket 18, thus it is not necessary for the outlet openings 64 to be large enough to supply all of the liquid to the pump 34. In another example, the size, shape and number of the outlet openings 64 and the perforations in the wash basket 18 may be configured such that the volumetric flow rate of liquid to the pump 34 ensures that the flow rate to the pump 34 is sufficient for proper operation of the pump 34, even if one or more of the outlet openings 64 are blocked.

Figure 6:
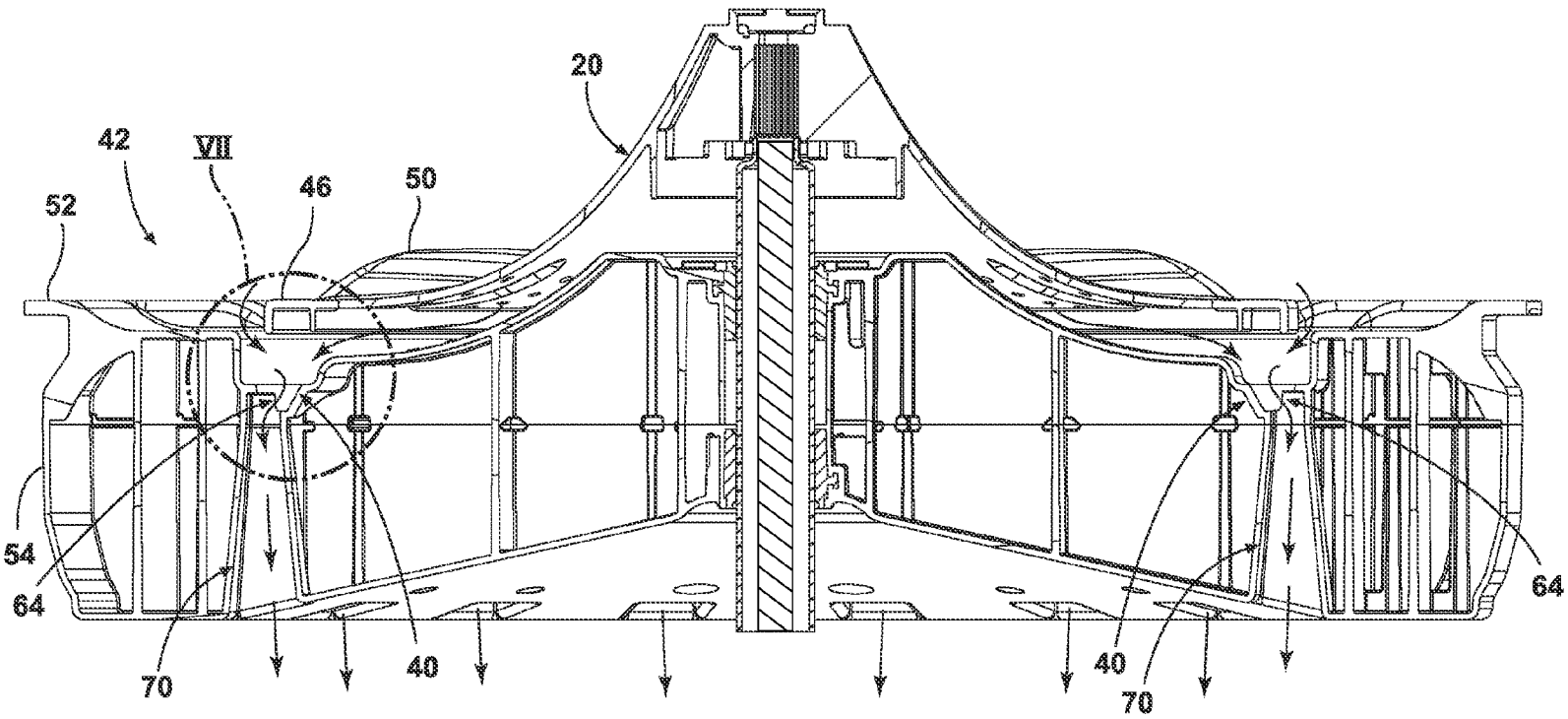
FIG. 6 is a cross-sectional view taken along the line 6-6 of the impeller and base shown in FIG. 3.

As may best be seen in FIG. 6, the base 42 may include multiple foreign object traps 40 in the upper part 52 of the base 42 that are aligned with multiple outlet passages 70 in the lower part 54 of the base 42 to provide a plurality of foreign object passageways 72 through which liquid, foreign objects below a predetermined diameter, and fine particulate matter entrained within the liquid may be expelled to the sump 16 and drain 36.

Figure 7:
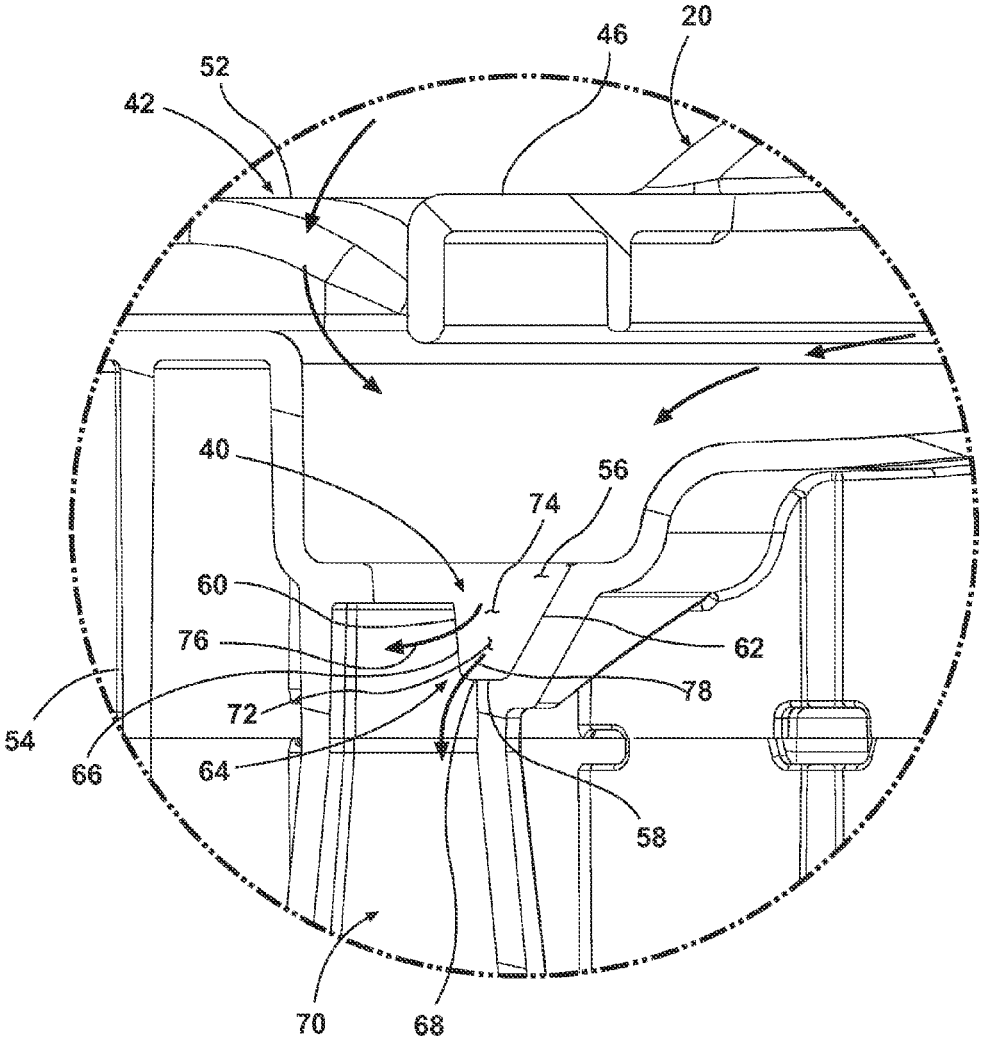
FIG. 7 is an enlarged view of a portion of the cross-sectional view shown in FIG. 6.

Referring now to FIG. 7, the foreign object passageway 72 may be defined by an inlet opening 74 and the outlet opening 64. The inlet opening 74 is defined by the channel bottom wall 58, outer sidewall 60 and inner sidewall 62 of the channel 56. As indicated by the arrows, during a recirculation or drain portion of a cycle of operation, liquid and entrained material flows beneath the clothes mover 20 and into the base 42. Liquid then flows into the foreign object trap 40 and through the inlet opening 74 and outlet opening 64 of the foreign object passageway 72. Any foreign objects of a predetermined diameter carried by the flow of liquid will enter the foreign object passageway 72 through the inlet opening 74 and be collected within the foreign object passageway 72. Liquid, foreign objects below a predetermined diameter, such as toothpicks, for example, and fine particulate matter entrained within the liquid, exit the foreign object passageway 72 via the outlet opening 64. The liquid then passes to the sump 16 and pump 34 through the outlet passages 70 in the lower part 54 of the base 42, where the liquid may then be directed along the appropriate conduit to either be recirculated or drained according to the cycle of operation.

Liquid, foreign objects below a predetermined diameter, and fine particulate matter entrained within the liquid may exit the foreign object passageway 72 through the first portion 66 of the outlet opening 64 formed in the outer sidewall 60, illustrated by flow arrow 76, and/or the second portion 68 of the outlet opening 64 formed in the channel bottom wall 58, illustrated by flow arrow 78, of the outlet opening 64. When the wash basket 18 is spinning, such as during an extraction cycle, for example, liquid within the wash basket is outwardly radially impelled, generally perpendicular to the axis of rotation of the wash basket 18. Liquid, foreign objects below a predetermined diameter, and fine particulate matter entrained within the liquid, that is located within the foreign object trap 40, may be impelled against the outer sidewall 60 of the channel 56. The first portion 66 of the outlet opening 64 in the outer sidewall 60 provides an outlet for the flow 76 of liquid and other suitably sized material that is being radially impelled against the outer sidewall 60 to exit the foreign object passageway 72. The sloped inner sidewall 62 facilitates movement of foreign objects, such as lint, and particulate matter, through the outlet opening 64 to decrease the accumulation of such material within the channel 56.

Figure 8:
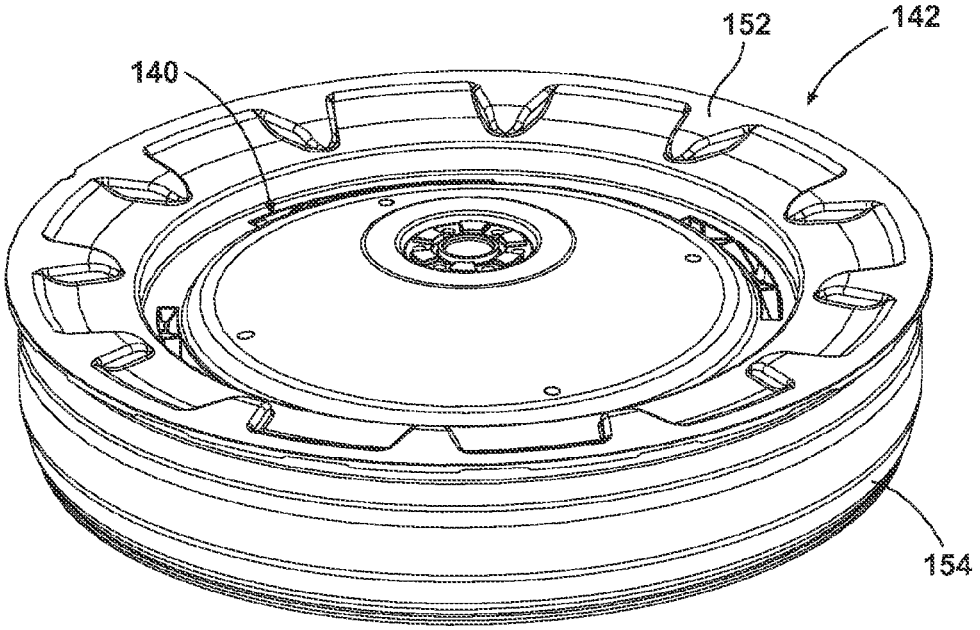
FIG. 8 is a perspective view of a base for use in a laundry treating appliance according to a second embodiment of the invention.

FIG. 8 illustrates a second embodiment of the invention comprising a base 142, which is similar to the base 42 except for the configuration of the foreign object trap 140. Therefore, elements in the base 142 similar to those of base 42 will be numbered with the prefix 100.

Figure 9:
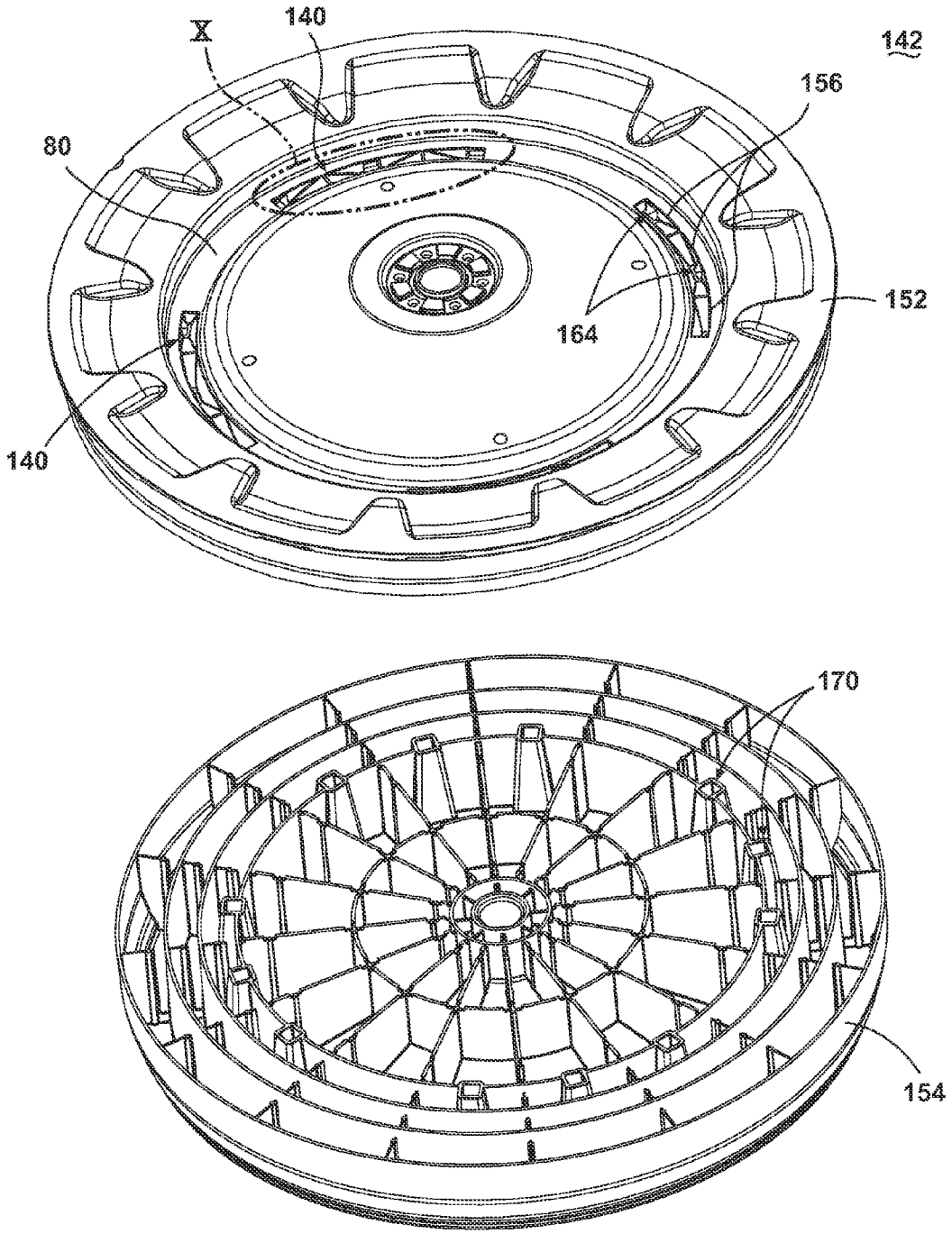
FIG. 9 is an exploded view of the base of FIG. 8.

Referring now to FIG. 9, the base 142 includes a plurality of discrete foreign object traps 140 located within a bottom wall 80 of the upper part 152 of the base 142. Each foreign object trap 140 extends partially around the circumference of the bottom wall 80. Each foreign object trap 140 includes a plurality of recesses 156 formed in the bottom wall 80, each recess 156 having an outlet opening 164. The base 142 further includes a lower part 154 having a plurality of outlet passages 170 which are aligned with the outlet openings 164 such that liquid and particulate matter which flows through the openings 164 may flow through the lower part 154 of the base 142 to the sump 16.

Figure 10:
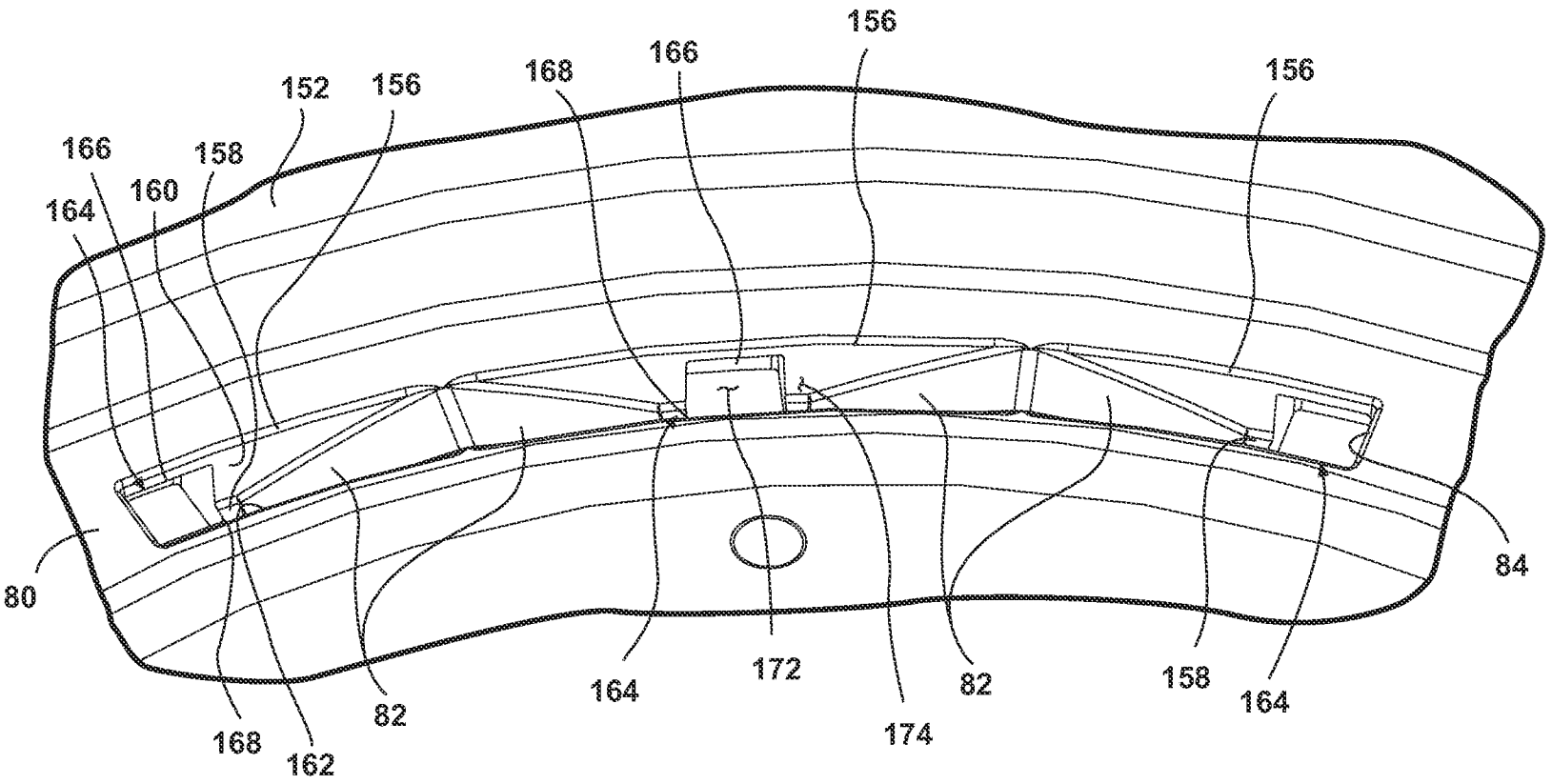
FIG. 10 is an enlarged view of a portion of the base of FIG. 9.

Referring now to FIG. 10, each recess 156 is defined by an outer sidewall 160, an inner sidewall 162 and a recess bottom wall 158. Each recess 156 may be coupled with an adjacent recess by an angled end wall 82 and with the bottom wall 80 of the base 142 by a generally vertical end wall 84. Each outlet opening 164 has a first portion 166 formed in the outer sidewall 160 and a second portion 168 formed in the recess bottom wall 158. Each foreign object trap 140 includes a plurality of foreign object passageways 172 defined by an inlet opening 174 and the outlet openings 164 of each recess 156.

During a recirculation or drain portion of a cycle of operation, liquid, which may include entrained material such as foreign objects and particulate matter, flows into the foreign object passageway 172 through the inlet opening 174 of each recess 156, in a manner similar to that described above for the foreign object trap 40. Liquid, foreign objects below a predetermined diameter, and fine particulate matter entrained within the liquid may exit the foreign object passageway 172 through the first portion 166 and/or the second portion 68 of the outlet opening 64. When the wash basket 18 is spinning, such as during an extraction cycle, for example, liquid within the wash basket 18 is outwardly radially impelled perpendicular to the axis of rotation of the wash basket 18. Liquid, foreign objects below a predetermined diameter, and fine particulate matter entrained within the liquid, that is located within the foreign object trap 140, may be impelled against the outer sidewall 160 of the recess 156. The first portion 166 of the outlet opening 164 in the outer sidewall 160 provides an outlet for the flow of liquid and other suitably sized material that is being radially impelled against the outer sidewall 160 to exit the foreign object passageway 172. The sloped inner sidewall 162 facilitates movement of foreign objects, such as lint, and particulate matter, through the outlet opening 164 to decrease the accumulation of such material within the recess 156. In a similar manner, the angled end walls 82 between adjacent recesses 156 aid in directing liquid and foreign objects towards the outlet openings 164.

While the foreign object traps 140 are illustrated as having three adjacent recesses 156, each having a foreign object passageway 172, it is within the scope of the invention for the foreign object traps 140 to include any suitable number of recesses having any desired dimension. For example, the dimensions of the angled end walls 82 may be provided so as to minimize trailing of threads and lint between adjacent outlet openings 164. In addition, while the base 142 is illustrated as having four sets of foreign object traps 140 discretely spaced about the bottom wall 80, the base 142 may have any number of foreign object traps 140 having any desired spacing.

The foreign object trap described herein provides a trap for preventing large foreign objects from flowing to the pump, where they may potentially interfere with the operation of the pump and/or damage the pump, while still allowing liquid and small foreign objects and entrained particulate matter that will not damage the pump, to flow through to the pump. The foreign object trap is provided with an outlet opening having two portions, a first portion which is not at a right angle to the axis of rotation of the wash basket and a second portion which is generally perpendicular to the axis of rotation. The second portion of the outlet opening provides an outlet for liquid and suitably sized material flowing downward by gravity. When the wash basket is spinning, liquid within the wash basket and foreign object trap may be impelled radially outward with respect to the axis of rotation, which may decrease the rate at which liquid flows downward by gravity through the second portion of the outlet. This may limit the volumetric flow rate of liquid to the pump during rotation of the wash basket, which may effect the operation of the pump and the efficiency of the cycle of operation. The first portion of the outlet opening provides an outlet for the liquid and entrained material that is radially impelled outward during spinning of the wash basket, increasing the volumetric flow rate of liquid to the pump.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

As is apparent from the foregoing specification, the invention is susceptible of being embodied with various alterations and modifications, which may differ particularly from those that, have been described in the preceding specification and description. It should be understood that we wish to embody within the scope of the patent warranted hereon all such modifications as reasonably and properly come within the scope of our contribution to the art.

What is claimed is:

1. A method of operating a laundry treating appliance having a foreign object trap located in a bottom of a wash basket underlying a clothes mover, the bottom of the wash basket having an upwardly extending wall, with at least the wash basket rotatable about an axis of rotation, the method comprising:

radially expelling liquid through an outlet opening of the foreign object trap located in the upwardly extending wall, the outlet opening having a first portion that is substantially parallel to the axis of rotation as the wash basket is rotated about the axis of rotation and a second portion which is substantially at a right angle to the axis of rotation as the wash basket is rotated about the axis of rotation, wherein the liquid is expelled radially outward primarily through the first portion.

2. The method of claim 1 wherein the radially expelling liquid comprises radially expelling liquid through multiple outlet openings.

3. The method of claim 1, further comprising expelling liquid through the outlet opening in a direction generally perpendicular to the axis of rotation.

4. The method of claim 1 wherein the upwardly extending wall at least partially defines at least one of: a step in the bottom, a channel in the bottom, or a recess in the bottom.

5. The method of claim 1 wherein the upwardly extending wall is one of continuous about the bottom or comprises discrete segments about the bottom.

6. The method of claim 1, further comprising radially expelling foreign objects below a predetermined diameter through the foreign object trap as the wash basket is rotated about the axis of rotation.

7. The method of claim 1, further comprising expelling liquid through the foreign object trap by gravity.

8. The method of claim 7 wherein the radially expelling liquid comprises radially expelling liquid through the first portion of the outlet opening in the foreign object trap that is not at a right angle to the axis of rotation and the expelling liquid by gravity comprises expelling liquid through the second portion of the outlet opening that is generally perpendicular to the axis of rotation.

9. The method of claim 7 wherein the radially expelling liquid and the expelling liquid by gravity expels liquid from the foreign object trap at a volumetric flow rate that is greater than a volumetric flow rate of one or more pumps provided with the laundry treating appliance to drain and/or recirculate liquid.

10. The method of claim 1, further comprising expelling water through a plurality of perforations in a peripheral wall of the wash basket.

11. A method of operating a laundry treating appliance having a foreign object trap located in a bottom of a wash basket underlying a clothes mover, with at least the wash basket rotatable about an axis of rotation, the method comprising:

radially expelling liquid through an outlet opening in the foreign object trap as the wash basket is rotated about the axis of rotation, the outlet opening of the foreign object trap having a first portion that is substantially parallel to the axis of rotation as the wash basket is rotated about the axis of rotation and a second portion which is substantially at a right angle to the axis of rotation as the wash basket is rotated about the axis of rotation, wherein the liquid is expelled radially outwardly primarily through the first portion.

12. The method of claim 11 wherein the radially expelling of liquid comprises radially expelling liquid through multiple outlet openings.

13. The method of claim 11, further comprising expelling liquid through the outlet opening in a direction generally perpendicular to the axis of rotation.

14. The method of claim 11 wherein the radially expelling liquid comprises radially expelling liquid through the first portion of an outlet opening provided in an upwardly extending wall in the bottom of the wash basket.

15. The method of claim 14 wherein the upwardly extending wall is one of continuous about the bottom or comprises discrete segments about the bottom.

16. The method of claim 11, further comprising expelling liquid through the foreign object trap by gravity.

17. The method of claim 16 wherein the radially expelling liquid comprises radially expelling liquid through the first portion of an outlet opening in the foreign object trap that is not perpendicular to the axis of rotation and the expelling liquid by gravity comprises expelling liquid through the second portion of the outlet opening that is generally perpendicular to the axis of rotation.

18. The method of claim 16 wherein the radially expelling liquid and the expelling liquid by gravity expels liquid from the foreign object trap at a volumetric flow rate that is greater than a volumetric flow rate of one or more pumps provided with the laundry treating appliance to drain and/or recirculate liquid.

19. The method of claim 11 further comprising expelling water through a plurality of perforations in a peripheral wall of the wash basket.

* * * * *